US007526239B2

(12) United States Patent
Kawano et al.

(10) Patent No.: US 7,526,239 B2
(45) Date of Patent: Apr. 28, 2009

(54) DEVELOPMENT ROLLER

(75) Inventors: Kota Kawano, Yokohama (JP); Takayuki Sugimura, Yokohama (JP); Kenichi Miyazaki, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 241 days.

(21) Appl. No.: 11/451,448

(22) Filed: Jun. 13, 2006

(65) Prior Publication Data

US 2007/0003331 A1 Jan. 4, 2007

(30) Foreign Application Priority Data

Jun. 13, 2005 (JP) ..... 2005-172261

(51) Int. Cl.
*G03G 15/08* (2006.01)

(52) U.S. Cl. ..... 399/286; 399/279; 399/265; 492/18; 492/53; 492/56

(58) Field of Classification Search ..... 399/286, 399/279, 265; 492/18, 53, 56
See application file for complete search history.

(56) References Cited

U.S. PATENT DOCUMENTS 3,337,485 A * 8/1967 Lawrence et al. ..... 524/251
6,555,210 B1 * 4/2003 Masuda et al. ..... 428/212
6,829,454 B2 * 12/2004 Miyakawa et al. ..... 399/159
2002/0119324 A1 * 8/2002 Harashima et al. ..... 428/423.3
2006/0029878 A1 * 2/2006 Yoshizawa et al. ..... 430/124

FOREIGN PATENT DOCUMENTS

JP 07-119733 B2 5/1995
JP 09-146340 A 6/1997

* cited by examiner

*Primary Examiner*—David M Gray
*Assistant Examiner*—G. M. Hyder
(74) *Attorney, Agent, or Firm*—Sughrue Mion, PLLC

(57) ABSTRACT

A development roller is provided which can ensure a desired surface roughness and roller hardness even when an elastic layer has not sufficient solvent resistance and which can be preferably used for a long period of time without generating any peeling of a coating film during a continuous long operation. In the development roller, an underlying conductive layer having at least one sublayer and a surface resin layer are provided on the elastic layer in that order. The elastic layer is formed of a foam material having a closed cell structure, the underlying conductive layer is formed from a water-based paint containing a conductive agent, and one of the sublayers of the underlying conductive layer that is in contact with the elastic layer is at least primarily composed of a chloroprene-methacrylic acid copolymer.

5 Claims, 1 Drawing Sheet

DEVELOPMENT ROLLER

BACKGROUND OF THE INVENTION

1. Field of the Invention

The present invention relates to a development roller (hereinafter simply referred to as a "roller" in some cases), and more particularly relates to a development roller used in a development process performed by an image forming device using an electrophotographic system.

2. Description of the Related Art

In an image forming device, such as a copying machine or a printer, using an electrophotographic system, roller members having conductivity are used in individual electrophotographic processes, such as development, electrification, and transfer (toner supply and cleaning).

Heretofore, as conductive rollers used as a development roller, an electrification roller, a transfer roller (toner supply and cleaning) and the like, a basic structure has been used in which a conductive elastic layer composed of a conductive rubber, high molecular weight elastomer, high molecular weight foam, or the like, which has conductivity obtained by using a conductive agent, is formed around the periphery of a conductive metal shaft, and in addition, on the periphery of this basic structure thus formed, at least one coating film is provided in order to obtain a desired surface roughness, conductivity, hardness, and the like.

The conductive roller thus described is formed in general by applying paint onto the surface of the elastic layer formed around the periphery of the metal shaft. However, when the coating film is formed on the elastic layer, depending on the solvent resistance thereof, the surface of the elastic layer may be dissolved with a solvent contained in the paint, and as a result, the desired surface roughness of the roller to be finally obtained may not be ensured in some cases.

In order to overcome the above problem, as a technique for eliminating the adverse influence of a solvent on the elastic layer by forming a coating film thereon using a water-based paint, for example, the following technique has been disclosed in Japanese Patent No. 2996846 (claims, paragraph [0005] etc). According to this technique, in a composite roller in which a surface coating film formed from a paint composed of an organic solvent and an organic compound dissolved therein is provided on the surface of a roller body, the surface being composed of a foam made from an organic compound having solubility or swelling properties to an organic solvent, a coating film formed from a mixed solution containing a predetermined organic compound and a water medium is provided as a solvent blocking film against the organic solvent of the paint forming the surface coating film between the roller body and the surface coating film so as to prevent the dissolution and swelling of the roller body which are caused by the organic solvent of the paint forming the surface coating film, and as a result, a composite roller having a smooth surface is obtained. In addition, in Japanese Unexamined Patent Application Publication No. 9-146340 (claims etc.), an electrification member has been disclosed in which a conductive layer formed from a water-based resin and a urethane modified acrylic resin layer are formed on the surface of an elastic foam layer in that order.

As described in the patent documents described above, by forming the coating film from a water-based paint on the elastic layer, the solvent blocking properties can be ensured, and as a result, for example, the surface of the elastic layer can be prevented from being roughened. However, according to the water-based resins which have been investigated, adhesion between the elastic layer and the coating film of the water-based paint is not sufficient in particular in the case of a roller such as a development roller which is driven by itself, and as a result, the coating film is disadvantageously peeled away during a continuous long operation.

SUMMARY OF THE INVENTION

Accordingly, an object of the present invention is to provide a development roller which can ensure desired roughness and roller hardness even when an elastic layer has not sufficient solvent resistance, and which can be preferably used for a long period of time without generating peeling of a coating film during a continuous long operation.

Through intensive research carried out by the inventor of the present invention, it was discovered that when a coating film formed from a chloroprene-methacrylic acid copolymer used as a water-based resin is provided on an elastic layer, peeling of the coating film at the surface of the elastic layer can be prevented and that the above-described problems can be solved, and as a result, the present invention was made.

That is, in accordance with one aspect of the present invention, there is provided a development roller comprising an elastic layer, an underlying conductive layer including at least one sublayer; and a surface resin layer, the underlying conductive layer and the surface resin layer being provided on the elastic layer in that order. In this development roller, the elastic layer comprises a foam material having a closed-cell structure, the underlying conductive layer is formed from a water-based paint containing a conductive agent, and one of said sublayers of the underlying conductive layer that is in contact with the elastic layer is at least primarily composed of a chloroprene-methacrylic acid copolymer.

According to the present invention, said one of the sublayers of the underlying conductive layer that is primarily composed of a chloroprene-methacrylic acid copolymer preferably has a thickness of 10 to 100 μm. In addition, the underlying conductive layer may be formed by dip coating of the water-based paint, and as the foam material, a polyurethane foam is preferably used. Furthermore, the surface resin layer preferably contains fine spherical particles.

According to the present invention, by forming the underlying conductive layer primarily composed of a chloroprene-methacrylic acid copolymer, that is a water-based resin, on the elastic layer, although having not sufficient solvent resistance, the elastic layer can be prevented from being roughened which is caused by a solvent, and a desired surface roughness and roller hardness can be ensured. In addition, the coating film is not peeled away even during a continuous long operation, and as a result, a development roller which can be preferably used for a long period of time can be realized.

DESCRIPTION OF THE PREFERRED EMBODIMENTS

Hereinafter, preferable embodiments of the present invention will be described in detail.

Figure 1A:
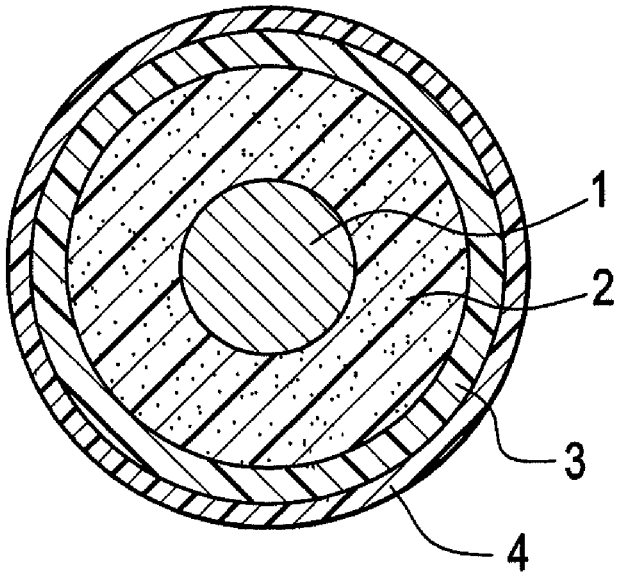
FIG. 1A is a cross-sectional view of a conductive roller according to an embodiment of the present invention.
Figure 1B:
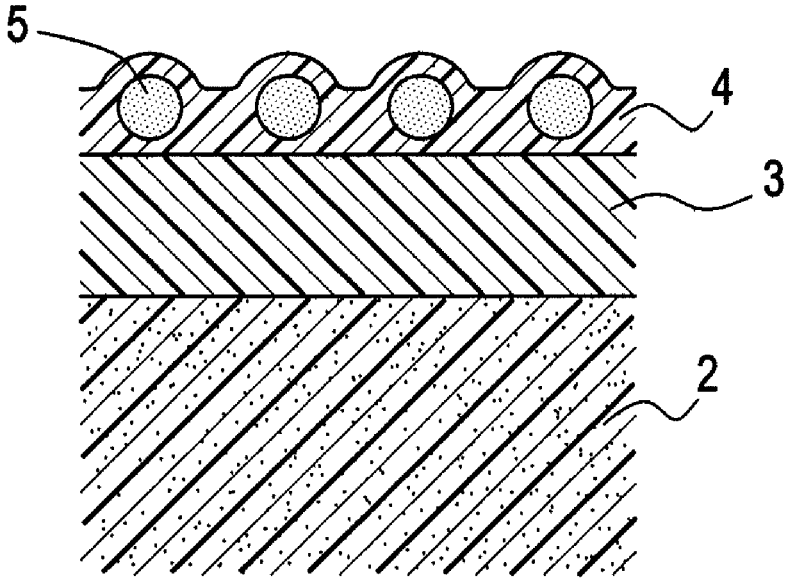
FIG. 1B is a cross-sectional view of a conductive roller according to an embodiment of the present invention.

FIGS. 1A and 1B each show a cross-sectional view of an example of a development roller according to the present invention. As shown in the figures, in the development roller according to the present invention, at least one layer is provided on an elastic layer 2 which is fixed to the periphery of a shaft 1, and in the example shown in the figures, one underlying conductive layer 3 and a surface resin layer 4 are provided on the elastic layer 2 in that order.

As the shaft 1, as long as having preferable conductivity, a material used for the shaft 1 is not particularly limited and any material may be used. For example, a metal shaft may be used which is formed from a solid metal core bar or a metal cylinder in which the inside is hollowed out, made of a steel material such as sulfur free-cutting steel plated with nickel or zinc, iron, stainless steel, aluminum, or the like.

The elastic layer 2 is made of a foam material having a closed cell structure, and in the present invention, a polyurethane foam is preferably used. As a polyurethane raw material forming this polyurethane foam, as long as containing a urethane bond, any resin may be used without any particular limitation. As a polyisocyanate used as the polyurethane raw material, for example, an aromatic isocyanate, an aliphatic isocyanate, an alicyclic isocyanate, or a derivative thereof may be used. Of the isocyanates mentioned above, the aromatic isocyanate or the derivative thereof is preferable, and tolylene diisocyanate, diphenylmethane diisocyanate, or the derivative thereof is particularly preferable. As the tolylene diisocyanate or the derivative thereof, for example, there may be used a crude tolylene diisocyanate, 2,4-tolylene diisocyanate, 2,6-tolylene diisocyanate, or a mixture of 2,4-tolylene diisocyanate and 2,6-tolylene diisocyanate, in addition, a urea-modified compound, a biuret-modified compound, a carbodiimide-modified compound, or a urethane-modified compound modified with a polyol or the like of the above mentioned tolylene diisocyanates may also be used. As the diphenylmethane diisocyanate or the derivative thereof, for example, diphenylmethane diisocyanate or the derivative thereof obtained by phosgenation of diaminodiphenylmethane or the derivative thereof may be used. As the derivative of diaminodiphenylmethane, for example, a polynuclear compound may be mentioned, and a pure diphenylmethane diisocyanate obtained from diaminodiphenylmethane, polymeric diphenylmethane diisocyanate obtained from a polynuclear compound of diaminodiphenylmethane or the like may be used. As for the number of functional groups of a polymeric diphenylmethane diisocyanate, a mixture of a pure diphenylmethane diisocyanate and polymeric diphenylmethane diisocyanates having various numbers of functional groups is generally used, and the average number of functional groups is preferably 2.05 to 4.00 and is more preferably 2.50 to 3.50. In addition, as a derivative obtained by modification of the afore-mentioned diphenylmethane diisocyanate or the derivative thereof, for example, a urethane-modified compound modified by polyol or the like, a dimer by urethidione formation, an isocyanurate-modified compound, a carbodiimide/urethoneimine modified compound, an allophanate-modified compound, a urea-modified compound, or a biuret-modified compound may also be used. In addition, a mixture of several types of diphenylmethane diisocyanates and the derivatives thereof may also be used.

As a polyol component used as the polyurethane raw material, for example, a polyether polyol obtained by addition polymerization of ethylene oxide and propylene oxide, a polytetramethylene ether glycol, a polyester polyol obtained by condensation of an acid component and a glycol component, a polyester polyol obtained by ring-opening polymerization of caprolacton, or a polycarbonate diol may be used. A polyether polyol obtained by addition polymerization of ethylene oxide and propylene oxide may be formed from materials which are optionally selected, for example, from water, propylene glycol, ethylene glycol, glycerin, trimethylolpropane, hexanetriol, triethanolamine, diglycerin, pentaerythritol, ethylenediamine, methylglucoside, aromatic diamine, sorbitol, sucrose, and phosphoric acid as a starting material; however, in particular, a product is preferable which is formed from materials optionally selected from water, propylene glycol, ethylene glycol, glycerin, trimethylolpropane, and hexanetriol as the starting material. As for the ratio between the ethylene oxide and the propylene oxide added to each other and the microstructure thereof, the ratio of ethylene oxide is preferably in the range of 2 to 95 percent by weight and is more preferably in the range of 5 to 90 percent by weight. In particular, a polyol having ethylene oxide added to the terminal thereof is preferably used. In addition, it is preferable that ethylene oxide and propylene oxide be randomly arranged in the molecular chain. When propylene glycol or ethylene glycol is used as the starting material, a bifunctional polyether polyol is obtained, and in this case, the weight average molecular weight of this polyether polyol is preferably in the range of 300 to 6,000 and is more preferably in the range of 400 to 3,000. In addition, when glycerin, trimethylolpropane, or hexanetriol is used as the starting material, a trifunctional polyether polyol is obtained, and in this case, the weight average molecular weight of this polyether polyol is preferably in the range of 900 to 9,000 and is more preferably in the range of 1,500 to 6,000. In addition, an appropriate mixture of a bifunctional polyol and a trifunctional polyol may also be used.

A polytetramethylene ether glycol is obtained, for example, by cationic polymerization of tetrahydrofuran, and the weight average molecular weight the polymer is preferably 400 to 4,000 and is more preferably 650 to 3,000. In addition, polytetramethylene ether glycols having different molecular weights are also preferably used in combination. Furthermore, a polytetramethylene ether glycol formed by copolymerization of alkylene oxides such as ethylene oxide and propylene oxide may also be used. A polytetramethylene ether glycol is also preferably used in combination with a polyether polyol formed by addition polymerization of ethylene oxide and propylene oxide, and in this case, the ratio of the polytetramethylene ether glycol to the polyether polyol formed by addition polymerization of ethylene oxide and propylene oxide on a weight basis is preferably set in the range of from 95 to 5 to 20 to 80 and is more preferably in the range of from 90 to 10 to 50 to 50. In addition, a polymer polyol obtained by modifying a polyol by acrylonitrile, a polyol obtained by adding melamine to a polyol, a diol such as butanediol, a polyol such as trimethylolpropane, and a derivative thereof may be used together with the above-described polyol component.

In addition, a polyol may be prepolymerized beforehand using a polyisocyanate, and as the method therefor, for example, a method may be mentioned including the step of sufficiently stirring a polyol and a polyisocyanate which are placed in an appropriate container, followed by maintaining a temperature of 30 to 90° C. and preferably 40 to 70° C. for 6 to 240 hours and more preferably 24 to 72 hours. In this case, the ratio of the polyol to the polyisocyanate is preferably adjusted so that the content of the isocyanate in the obtained prepolymer is preferably in the range of 4 to 30 percent by weight, and the above content is more preferably in the range of 6 to 15 percent by weight. When the content of the isocyanate is less than 4 percent by weight, since the stability of the prepolymer is degraded, curing may occur during storage, and as a result, the prepolymer may not be used in some cases. In addition, when the content of the isocyanate is more than 30 percent by weight, the content of a polyisocyanate which is not prepolymerized is increased, and since this polyisocyanate is cured with a polyol component used in a polyurethane curing reaction which will be carried out later by a reaction mechanism similar to a one-shot manufacturing process that is performed without passing thorough a prepolymerization reaction, and hence the effect of using the prepolymer method is decreased. As the polyol component in the case in which an isocyanate component is used which obtained by prepolymerizing a polyol beforehand with a polyisocyanate, besides the above-described polyol component, a diol such as ethylene glycol or butanediol, a polyol such as trimethylolpropane or sorbitol, or a derivative thereof may also be used.

To the polyurethane raw material, a conductive agent such as an ion conductive agent or an electron conductive agent, filler such as carbon black or an inorganic carbonate, an antioxidant such as phenol or phenylamine, a friction-reducing agent, a charge-adjusting agent, and the like may be added. As an example of the ion conductive agent, for example, there may be mentioned an ammonium salt such as perchlorate, chlorate, hydrochlorate, bromate, iodate, hydrofluoroborate, sulfate, ethyl sulfate, carboxylate, or sulfonate of tetraethylammonium, tetrabutylammonium, dodecyltrimethylammonium (such as lauryltrimethylammonium), hexadecyltrimethylammonium, octadecyltrimethylammonium (such as stearyltrimethylammonium), benzyltrimethylammonium, or fatty acid-modified dimethylethylammonium; or perchlorate, chlorate, hydrochlorate, bromate, iodate, hydrofluoroborate, trifluoromethyl sulfate, or sulfonate of an alkali metal such as lithium, sodium, or potassium, or an alkaline-earth metal such as calcium or magnesium. As an example of the electron conductive agent, for example, there may be mentioned conductive carbon such as Ketjen black or acetylene black, carbon for rubber such as SAF, ISAF, HAF, FEF, GPF, SRF, FT, or MT, carbon for ink processed by oxidation treatment, pyrolytic carbon, natural graphite, artificial graphite, a conductive metal oxide such as tin oxide, titanium oxide, or zinc oxide, or a metal such as nickel, copper, silver, or germanium. These conductive agents may be used alone or in combination. The amount of the conductive agent to be added is not particularly limited and may be optionally determined in accordance with desired properties; however, with respect to 100 parts by weight of the polyurethane raw material, the amount of the conductive agent is set to 0.1 to 40 parts by weight and is preferably set to 0.3 to 20 parts by weight.

As a catalyst used for the curing reaction of the polyurethane raw material, for example, there may be mentioned a monoamine such as triethylamine or dimethylcyclohexylamine; a diamine such as tetramethylethylenediamine, tetramethylpropanediamine or tetramethylhexanediamine; a triamines such as pentamethyldiethylenetriamine, pentamethyldipropylenetriamine or tetramethylguanidine; cyclic amines such as triethylenediamine, dimethylpiperazine, methylethylpiperazine, methylmorpholine, dimethylaminoethylmorpholine or dimethylimidazole; an alcoholamine such as dimethylaminoethanol, dimethylaminoethoxyethanol, trimethylaminoethylethanolamine, methylhydroxyethylpiperazine or hydroxyethylmorpholine; an ether amine such as bis(dimethylaminoethyl) ether or ethylene glycol bis(dimethyl)aminopropyl ether; or an organometal compound such as stannous octonate, dibutyltin diacetate, dibutyltin dilaurate, dibutyltin mercaptide, dibutyltin thiocarboxylate, dibutyltin dimaleate, dioctyltin mercaptide, dioctyltin thiocarboxylate, phenylmercury propionate or lead octenate. These catalysts may be used alone or in combination.

In the present invention, a silicone foam stabilizer and/or a surfactant is preferably added to the polyurethane raw material in order to stabilize cells of a foam material. As the silicone foam stabilizer, for example, a dimethylpolysiloxane-polyoxyalkylene copolymer is preferably used and is more preferably formed from a dimethylpolysiloxane portion having a molecular weight of 350 to 15,000 and a polyoxyalkylene portion having a molecular weight of 200 to 4,000. The molecular structure of the polyoxyalkylene portion is preferably an addition polymerization structure formed from ethylene oxide or an addition copolymerization structure formed from ethylene oxide and propylene oxide, and the molecular terminal is also preferably formed from ethylene oxide. As the surfactant, for example, there may be mentioned an ionic surfactant, such as a cationic surfactant, an anionic surfactant, and an amphoteric surfactant, and a nonionic surfactant selected from various polyethers and polyesters. The amount of the silicon foam stabilizer or that of the surfactant to be added to 100 parts by weight of the polyurethane raw material is preferably set to 0.1 to 10 parts by weight and is more preferably set to 0.5 to 5 parts by weight.

The density of a polyurethane foam which is used in the present invention is preferably 0.2 to 0.8 g/cm$^3$ and is more preferably 0.3 to 0.6 g/cm$^3$. In addition, the Asker C hardness of the polyurethane foam is preferably 15 to 70° and is more preferably 15 to 45°. In the present invention, as a method for foaming the polyurethane raw material beforehand, for example, a mechanical froth method, a water foaming method, or a froth method using a foaming agent, which has been carried out, may be used; however, in order to obtain a polyurethane foam having a closed cell structure in which the density is 0.2 to 0.8 g/cm$^3$ and the Asker C hardness is 20 to 65°, a mechanical froth method is preferably used in which foaming is performed by mechanical stirring while an inert gas is being mixed with the polyurethane raw material. In this case, as the inert gas used in the mechanical froth method, any inert gas may be used as long as being inert in a polyurethane reaction, and besides inert gases in the narrow sense, such as helium, argon, xenon, radon, and krypton, for example, gases such as nitrogen, carbon dioxide, and dry air may also be used which do not react with the polyurethane raw material. When a foamed polyurethane raw material is charged in a metal mold or the like, followed by curing, a polyurethane foam is obtained having a self-skin layer (film having a small layer thickness) which is formed at a place in contact with the metal mold. In this step, when the inside surface of the metal mold is coated with a fluorinated resin or the like, release properties can be imparted to the metal mold.

In addition, molding conditions of the elastic layer 2 are not particularly limited and may be performed in accordance with general molding conditions, and for example, the elastic layer 2 may be obtained by the steps of starting foaming of a polyurethane raw material at a temperature of 15 to 80° C. and preferably 20 to 65° C., then charging the raw material into a metal mold in which the shaft 1 is placed, then performing curing at approximately 70 to 120° C., and removing the cured product from the mold.

In addition, as described above, the underlying conductive layer 3 includes at least one sublayer and is formed from a water-based paint containing a conductive agent; however, in the present invention, it is important that one of said sublayers forming the underlying conductive layer 3 that is in contact with the elastic layer 2 be at least primarily composed of a chloroprene-methacrylic acid copolymer. When the underlying conductive layer primarily composed of a chloroprene-methacrylic acid copolymer, which is a water-based resin, is disposed on the elastic layer 2, the adhesion to the elastic layer 2 can be increased as compared to that in the past, and as a result, the coating film can be prevented from being peeled away during a continuous long operation. The chloroprene-methacrylic acid copolymer is represented by the following general formula (1).

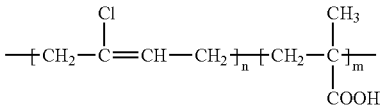

(1)

In the present invention, when one sublayer forming the underlying conductive layer 3 that is directly in contact with the elastic layer 2 is formed from a coating film primarily composed of a chloroprene-methacrylic acid copolymer, predetermined effects can be obtained. When the underlying conductive layer 3 is formed of a plurality of sublayers, any layer other than the sublayer that is directly in contact with the elastic layer 2 may be formed from a chloroprene-methacrylic acid copolymer or another water-based resin, and the type of water-based paint is not particularly limited.

As said another water-based paint which may be used when the underlying conductive layer 3 is formed of a plurality of sublayers, for example, a rubber-type, a urethane-type or an acrylic-type paint may be mentioned, and at least one selected therefrom is preferably used. For example, latex of natural rubber (NR), chloroprene rubber (CR), nitrile rubber (NBR) or styrene-butadiene rubber (SBR) may be preferably used as the rubber-type paint; emulsion or dispersion of an ether or an ester-based material may be preferably used as the urethane-type paint; and as the acrylic-type paint, emulsion of an acrylic or an acryl styrene material may be preferably used. In addition, as for a conductive agent to be added to the paint described above, a conductive agent similar to that described for the elastic layer 2 may be used and is not particularly limited. To the underlying conductive layer 3, whenever desired, a vulcanizing agent, a vulcanization accelerator, an anti-aging agent, or the like may be optionally added.

In addition, the sublayer forming the underlying conductive layer 3 and being primarily composed of a chloroprene-methacrylic acid copolymer is preferably formed to have a thickness in the range of 10 to 100 μm. In order to reliably prevent damage caused by a solvent contained in the paint forming the surface resin layer 4, oozing of contaminants from the elastic layer 2 and the like, the thickness is preferably set to 10 μm or more. The total thickness of the underlying conductive layer 3 is not particularly limited; however, when the thickness is too large, since the underlying conductive layer 3 may not be able to follow the flexibility of the elastic layer 2, cracking or peeling may occur in some cases. In addition, since the roller itself becomes harder, degradation in roller performance such as toner damage may occur.

The underlying conductive layer 3 is formed by applying a water-based paint primarily composed of a chloroprene-methacrylic acid copolymer onto the elastic layer 2, and whenever desired, another water-based paint may be further applied onto the above water-based paint, so that the underlying conductive layer 3 may be formed from at least one sublayer. The application method is not particularly limited, and for example, a known coating method, such as dip coating, spray coating, or roll coater coating, may be used; however, dip coating is preferably used. In the case of a roller body made of a foam material having an open cell structure as described in Japanese Patent No. 2996846, since the water-based paint permeates the inside of the cells, a smooth coating film cannot be formed by dip coating; however, since the elastic layer 2 of the present invention has a closed-cell structure, a smooth coating film can be formed even by dip coating.

In addition, the microhardness of the underlying conductive layer 3 is preferably in the range of 15 to 45° at a thickness of 500 μm, and when the hardness as described above is obtained, a desired roller hardness can be realized at the roller surface which is finally obtained. The microhardness described above can be measured, for example, by a micro rubber hardness meter MD-1.

The surface resin layer 4 can be formed from a solvent-based paint primarily containing a urethane-type, an acrylic-type, an acrylic-urethane-type, or a fluorine-type compound, and as shown in an enlarged cross-sectional view of FIG. 1B, when fine spherical particles 5 made of polyurethane, polyacrylate, or silica are contained in the surface resin layer 4, the surface roughness can be adjusted. The surface roughness of the surface resin layer 4 which is represented by the arithmetic average roughness Ra in accordance with Japanese Industrial Standards (hereinafter referred to as "JIS") is generally 2 μm or less and, in particular, is preferably in the range of 0.5 to 1.5 μm. In addition, when the above-described ion conductive agent or electron conductive agent is optionally added as a conductive agent, desired conductivity can be obtained. The thickness of the surface resin layer 4 is not particularly limited; however, the thickness is generally 1 to 50 μm and is preferably set to approximately 1 to 40 μm.

EXAMPLES

Hereinafter, the present invention will be described in detail with reference to the examples.

Example 1

First of all, to the periphery of a core bar 1 (8 mm in diameter, 260 mm in length, material: sulfur free-cutting steel), a polyurethane foam was fixed by a mechanical froth method.

In particular, a polyurethane raw material containing 100 parts by weight of an isocyanate component (prepolymerized isocyanate TDI+polyol), 20 parts by weight of a polyol component (polyether polyol), 2 parts by weight of carbon black (acetylene black), and 0.2 parts by weight of an ion conductive agent (sodium perchlorate) was prepared and was then mechanically stirred while dry air was mixed with the polyurethane raw material, so that foaming was performed. This foamed polyurethane raw material was charged in a split metal mold having a cylindrical shape, the mold having holes at end portions thereof through which a shaft was held and having metal caps supporting the shaft. Inside the mold, the core bar 1 provided with an adhesive around the periphery thereof was placed. Subsequently, the mold into which the foamed polyurethane raw material was charged was held in a hot wind oven at 90° C. for 4 hours, so that the foamed polyurethane raw material was cured.

The cured polyurethane foam was removed from the mold and was then coated with a water-based paint by dip coating which was composed of 100 parts by weight of a chloroprene-methacrylic acid copolymer (trade name: Shoprene SRX-1412, manufactured by Showa Denko K. K.) and 3.5 parts by weight of carbon black (Ketjen black) blended therewith, so that the underlying conductive layer 3 was formed around the periphery of the elastic layer 2 so as to have a thickness of 60 μm. Next, dip coating of a polyurethane-based paint containing spherical polyurethane particles having a D of 10 μm and carbon black (acetylene black) blended therewith was performed, so that the surface resin layer 4 was formed to have a thickness of 10 μm, and as a result, a development roller was formed in which the diameter of the roller body portion was 16 mm and the length was 240 mm. The surface roughness of the roller thus formed was 0.6 to 1.5 μm in terms of the arithmetic average roughness Ra in accordance with JIS.

Examples 2 to 5

Development rollers were formed in a manner similar to that in Example 1 except that the thickness of the underlying conductive layer 3 was set to 8, 10, 100, and 105 μm. The surface roughness of the rollers thus formed was in the range of 0.6 to 1.5 μm in terms of the arithmetic average roughness Ra in accordance with JIS.

Example 6

A development roller was formed in a manner similar to that in Example 1 except that a water-based paint composed of 100 parts by weight of a chloroprene-methacrylic acid copolymer (trade name: Shoprene SRX-1412, manufactured by Showa Denko K. K.) and 3.5 parts by weight of carbon black (Ketjen black) blended therewith was applied as a first sublayer by dip coating onto the cured polyurethane foam removed from the mold to form a coating film having a thickness of 10 μm, and that as a second sublayer, dip coating of an acrylic emulsion containing carbon black (Ketjen black) was performed to form a coating film having a thickness of 50 μm so that the underlying conductive layer 3 was formed to have a total thickness of 60 μm. The surface roughness of the roller thus formed was 0.6 to 1.5 μm in terms of the arithmetic average roughness Ra in accordance with JIS.

Example 7

A development roller was formed in a manner similar to that in Example 1 except that a water-based paint composed of 100 parts by weight of a chloroprene-methacrylic acid copolymer (trade name: Shoprene SRX-1412, manufactured by Showa Denko K. K.) and 3.5 parts by weight of carbon black (Ketjen black) blended therewith was applied as a first sublayer by dip coating onto the cured polyurethane foam removed from the mold to form a coating film having a thickness of 10 μm, that as a second sublayer, dip coating of an acrylic emulsion containing carbon black (Ketjen black) was performed to form a coating film having a thickness of 25 μm, and that as a third sublayer, a CR rubber latex paint containing carbon black (Ketjen black) was applied by dip coating to form a coating film having a thickness of 25 μm so that the underlying conductive layer 3 was formed to have a total thickness of 60 μm. The surface roughness of the roller thus formed was 0.6 to 1.5 μm in terms of the arithmetic average roughness Ra in accordance with JIS.

Comparative Example

A development roller was formed in a manner similar to that in Example 1 except that an acrylic emulsion paint containing carbon black (Ketjen black) was applied as a first sublayer by dip coating onto the cured polyurethane foam removed from the mold to form a coating film having a thickness of 30 μm, and that as a second sublayer, a CR rubber latex paint containing carbon black (Ketjen black) was applied by dip coating to form a coating film having a thickness of 30 μm so that the underlying conductive layer 3 was formed to have a total thickness of 60 μm. The surface roughness of the roller thus formed was 0.6 to 1.5 μm in terms of the arithmetic average roughness Ra in accordance with JIS.

(Cross-Cut Adhesion Test)

For the development rollers formed in the examples and the comparative example, a cross-cut adhesion test was performed in accordance with JIS K 5400. In this test, 25 cross-cuts at a regular interval of 2 mm were formed on the roller surface, and a gum tape was adhered thereon along the longitudinal direction of the roller, followed by peeling of the gum tape. Subsequently, by counting the number of cross-cuts remaining on the roller surface, the adhesion strength was evaluated.

(Endurance Test Using Actual Device)

The development rollers obtained in the examples and the comparative example were each fitted as a development roller into a printer cartridge, and an image-printing endurance test was performed for 10,000 sheets by using Laserjet 4050 manufactured by Hewlett-Packard Development Company. The evaluation was performed whether peeling occurred or not during the endurance test.

The results are also shown in the following Table 1.

TABLE 1

| | | EXAMPLE 1 | EXAMPLE 2 | EXAMPLE 3 | EXAMPLE 4 |
|---|---|---|---|---|---|
| UNDERLYING CONDUCTIVE LAYER 1 | PAINT | CHLOROPRENE-METHACRYLIC ACID COPOLYMER | CHLOROPRENE-METHACRYLIC ACID COPOLYMER | CHLOROPRENE-METHACRYLIC ACID COPOLYMER | CHLOROPRENE-METHACRYLIC ACID COPOLYMER |
| | FILM THICKNESS (μm) | 60 | 8 | 10 | 100 |
| UNDERLYING CONDUCTIVE LAYER 2 | PAINT | — | — | — | — |
| | FILM THICKNESS (μm) | — | — | — | — |
| UNDERLYING CONDUCTIVE LAYER 3 | PAINT | — | — | — | — |
| | FILM THICKNESS (μm) | — | — | — | — |
| CROSS-CUT | NUMBER OF REMAINING | 25/25 | 25/25 | 25/25 | 25/25 |

TABLE 1-continued

| | | | | | |
|---|---|---|---|---|---|
| ADHESION TEST | CROSS-CUTS EVALUATION POINT | 10POINT | 10POINT | 10POINT | 10POINT |
| ENDURANCE TEST USING ACTUAL DEVICE | | NO PEELING | NO PEELING | NO PEELING | NO PEELING |

| | | EXAMPLE 5 | EXAMPLE 6 | EXAMPLE 7 | COMPARATIVE EXAMPLE |
|---|---|---|---|---|---|
| UNDERLYING CONDUCTIVE LAYER 1 | PAINT | CHLOROPRENE-METHACRYLIC ACID COPOLYMER | CHLOROPRENE-METHACRYLIC ACID COPOLYMER | CHLOROPRENE-METHACRYLIC ACID COPOLYMER | ACRYLIC EMULSION |
| | FILM THICKNESS (μm) | 105 | 10 | 10 | 30 |
| UNDERLYING CONDUCTIVE LAYER 2 | PAINT | — | ACRYLIC EMULSION | ACRYLIC EMULSION | C/R RUBBER LATEX |
| | FILM THICKNESS (μm) | — | 50 | 25 | 30 |
| UNDERLYING CONDUCTIVE LAYER 3 | PAINT | — | — | C/R RUBBER LATEX | |
| | FILM THICKNESS (μm) | — | — | 25 | — |
| CROSS-CUT ADHESION TEST | NUMBER OF REMAINING CROSS-CUTS | 25/25 | 25/25 | 25/25 | 16/25 |
| | EVALUATION POINT | 10POINT | 10POINT | 10POINT | 2POINT |
| ENDURANCE TEST USING ACTUAL DEVICE | | NO PEELING | NO PEELING | NO PEELING | COATING FILM BEING PEELED AT TWO SIDES OF ROLLER |

As shown in Table 1, by the development rollers formed in the examples in which the underlying conductive layer formed from a chloroprene-methacrylic acid copolymer was provided on the elastic layer, superior results were obtained in both the cross-cut adhesion test and the endurance test using an actual device. On the other hand, by the development roller of the comparative example in which the underlying conductive layer formed from another water-based paint was provided on the elastic layer, peeling occurred in most of the cross-cuts in the cross-cut adhesion test, and in the endurance test, peeling of the coating film occurred.

What is claimed is:

1. A development roller comprising:

an elastic layer;

an underlying conductive layer including at least one sublayer; and a surface resin layer, the underlying conductive layer and the surface resin layer being provided on the elastic layer in that order, wherein the elastic layer comprises a foam material having a closed-cell structure, the underlying conductive layer is formed from a water-based paint containing a conductive agent, and one of said sublayers of the underlying conductive layer that is in contact with the elastic layer is at least primarily composed of a chloroprene-methacrylic acid copolymer.

2. The development roller according to claim 1, wherein said one of the sublayers of the underlying conductive layer that is primarily composed of a chloroprene-methacrylic acid copolymer has a thickness of 10 to 100 μm.

3. The development roller according to claim 1, wherein the underlying conductive layer is formed by dip coating of the water-based paint.

4. The development roller according to claim 1, wherein the foam material is a polyurethane foam.

5. The development roller according to claim 1, wherein the surface resin layer contains fine spherical particles.

* * * * *